US005569875A

United States Patent [19]

Fey

[11] Patent Number: 5,569,875

[45] Date of Patent: Oct. 29, 1996

[54] METHODS OF MAKING EXPLOSIVE COMPOSITIONS, AND THE RESULTING PRODUCTS

[75] Inventor: Warren O. Fey, Las Vegas, Nev.

[73] Assignee: Legend Products Corporation, Las Vegas, Nev.

[21] Appl. No.: 260,717

[22] Filed: Jun. 16, 1994

Related U.S. Application Data

[62] Division of Ser. No. 851,753, Mar. 16, 1992, abandoned.

[51] Int. Cl.[6] ..... C06B 31/02

[52] U.S. Cl. ..... 149/61; 149/83

[58] Field of Search ..... 149/83, 61

[56] References Cited

U.S. PATENT DOCUMENTS

| | | | |
|---|---|---|---|
| 907,007 | 12/1908 | Ceipek . | |
| 2,590,067 | 3/1952 | Pecherer | 260/344.5 |
| 3,332,848 | 7/1967 | Magid | 167/82 |
| 3,367,772 | 2/1968 | McMichael | 75/130 |
| 3,798,091 | 3/1974 | Knight | 149/61 |
| 3,837,942 | 9/1974 | Catanzarite | 149/83 |
| 3,862,866 | 1/1975 | Timmerman et al. | 149/21 |
| 3,873,713 | 3/1975 | Haas et al. | 424/280 |
| 3,910,805 | 10/1975 | Catanzarite | 149/83 |
| 3,957,598 | 5/1976 | Merkl | 556/147 |
| 3,964,255 | 6/1976 | Catanzarite | 149/77 |
| 3,971,729 | 7/1976 | Timmerman | 149/77 |
| 3,986,980 | 10/1976 | Cort | 252/404 |
| 4,043,937 | 8/1977 | Kiss et al. | 252/407 |
| 4,111,958 | 9/1978 | Crawford | 260/340.7 |
| 4,159,990 | 7/1979 | Andrews | 260/343.7 |
| 4,202,942 | 5/1980 | Kita et al. | 435/262 |
| 4,232,168 | 11/1980 | Crawford | 560/174 |
| 4,233,253 | 11/1980 | Hoff et al. | 534/14 |
| 4,245,049 | 1/1981 | Kita et al. | 435/138 |
| 4,276,219 | 6/1981 | Andrews | 260/343.7 |
| 4,368,330 | 1/1983 | Andrews | 549/315 |
| 4,421,924 | 12/1983 | Crawford | 549/370 |
| 4,497,676 | 2/1985 | Kurtz | 149/2 |
| 4,728,376 | 3/1988 | Kurtz | 149/21 |
| 4,797,274 | 1/1989 | Miki et al. | 424/76.1 |
| 4,830,716 | 5/1989 | Ashmead | 556/148 |
| 4,851,130 | 7/1989 | May | 210/750 |
| 4,881,993 | 11/1989 | Furbringer et al. | 149/46 |
| 4,908,080 | 3/1990 | Amano et al. | 149/2 |
| 4,964,929 | 10/1990 | Beyeler et al. | 149/109.6 |
| 4,975,290 | 12/1990 | Artz et al. | 426/74 |
| 4,992,282 | 2/1991 | Mehansho et al. | 426/72 |
| 4,997,496 | 3/1991 | Wehrli | 149/18 |
| 5,002,970 | 3/1991 | Eby | 514/494 |
| 5,197,758 | 3/1993 | Lund et al. | 149/61 |

OTHER PUBLICATIONS

Hawley, *The Condensed Chemical Dictionary*, 9th Ed., P. 381, Von Nostrand Reinhold (1977) New York, Q05CS.

"Guns Magazine", Aug. 1984 issue, pp. 45,63–66, Jim Woods.

*Primary Examiner*—Edward A. Miller

*Attorney, Agent, or Firm*—Donald W. Margolis

[57] ABSTRACT

An improved fuel composition suitable for use in explosive compositions is obtained by forming a reaction product of a transition metal or transition metal compound, preferably iron or iron oxide, with ascorbic or erythorbic acid. The improved fuel composition is combined in admixture with an inorganic oxidizing agent to produce an improved explosive composition. When the improved fuel composition is combined in admixture with potassium nitrate, an improved explosive composition suitable for use as a gunpowder having enhanced performance characteristics is obtained. Methods for making the fuel composition and the explosive composition are also disclosed.

17 Claims, 1 Drawing Sheet

METHODS OF MAKING EXPLOSIVE COMPOSITIONS, AND THE RESULTING PRODUCTS

This is a divisional of application Ser. No. 07/851,753, filed Mar. 16, 1992, and now abandoned. Priority of the prior application is claimed pursuant to 35 USC § 120.

FIELD OF THE INVENTION

This invention relates to fuels and explosive compositions and methods of making same. More specifically, this invention relates to fuels used in making explosive compositions with the explosive compositions finding particular but not exclusive utility as an improved gunpowder.

BACKGROUND OF THE INVENTION

Explosive compositions generally comprise a fuel component and an oxidizer component. Depending on the characteristics of the fuel component, the oxidizer component and the explosive composition as a whole, differing explosive compositions will perform differently. Some explosive compositions perform best as deflagrating agents or propellants. Other explosive compositions are utilized as detonating compounds. Still other explosive compositions are utilized in pyrotechnic applications. A single fuel can be used in different applications by varying the oxidizer with which it is combined.

By way of example, Black Powder is one explosive composition which has been used for centuries as a propellant, deflagrating agent, explosive and pyrotechnic compound. Gunpowder of the type known as Black Powder is commonly composed of an intimate mixture of potassium nitrate, sulfur and charcoal. In Black Powder, potassium nitrate is the oxidizing agent while sulfur and charcoal comprise the fuel component. The end products resulting from the combustion of Black Powder cause noxious smoke, residue and fouling. Black Powder also exhibits some hygroscopicity, which can limit product life and creates unpredictability in performance. Additionally, Black Powder is extremely dangerous to manufacture, store and handle. The deficiencies exhibited by Black Powder are a direct result of the fuel and oxidizer combination which comprise Black Powder.

Explosive compositions have been formulated which exhibit improved safety or performance characteristics over Black Powder when used as a gunpowder. One such explosive composition is Pyrodex®, a composition of potassium nitrate, sulfur, charcoal, potassium perchlorate, various binders and modifiers and other constituents. Other such gunpowders are described in U.S. Pat. No. 4,497,676 issued to Kurtz for Gunpowder Substituted Composition and Method, U.S. Pat. No. 4,728,376 issued to Kurtz for Explosive Composition and Method, U.S. Pat. No. 4,881,993 issued to Fürbringer et al. for Explosive and Propellant Composition and Method of Preparation, U.S. Pat. No. 4,964,429 issued to Beyeler et al. for Preparation of Explosives Containing Degradation Products of Ascorbic or Isoascorbic Acid, and U.S. Pat. No. 4,997,496 issued to Wehrli for Explosive and Propellant Composition and Method. The explosive compositions disclosed in these patents consist primarily of an organic acid fuel, usually ascorbic or erythorbic acid, and an inorganic nitrate oxidizer, usually potassium nitrate. When such explosive compositions are used as gunpowders, they still exhibit limited performance capabilities and excessive hygroscopicity, which leads to product storage, handling and performance problems.

It is the principal object of the present invention to produce a fuel composition for use in explosive compositions evidencing improved adhesive qualities and exhibiting improved performance. It is a further object of the present invention to produce a fuel composition suitable for use as binder and modifier.

It is a still further object of the present invention to produce an explosive composition comprising an improved fuel composition and an oxidizing agent. It is a further object of the present invention to use an improved fuel composition to form an explosive composition, which, when utilized as a gunpowder, evidences improved performance, including improved burn characteristics producing greater velocities with less residue and less hygroscopicity than Black Powder and existing gunpowder substitutes. A related object is to provide a method for making an improved fuel composition and a method for making an explosive composition in a safe and cost effective manner, said explosive composition having the foregoing character and containing an improved fuel composition.

SUMMARY OF THE INVENTION

A significant aspect of the present invention relates to a fuel formed as a result of a reaction between an organic acid and a transition metal or transition metal compound. Another significant and specific aspect of the present invention relates to a fuel formed as a result of a reaction between an organic acid and an iron or iron compound. Yet another significant aspect of the present invention relates to a binder suitable for use in explosive compositions formed as a result of a reaction between an organic acid and a transition metal or transition metal compound.

Another significant aspect of the present invention relates to an explosive composition of an inorganic oxidizing agent and the fuel product formed as a result of a reaction between an organic acid and a transition metal or transition metal compound, preferably iron or an iron compound. Yet another significant aspect of the present invention relates to an explosive composition containing iron ascorbate and an organic acid in admixture.

Another significant aspect of the present invention relates to a method for making a fuel suitable for use in an explosive composition by forming a reaction product of an organic acid and a transition metal or transition metal compound. A further significant aspect of the present invention relates to a method for making a fuel suitable for use in an explosive composition by forming a reaction product of an organic acid and iron or an iron compound. A still further significant aspect of the present invention relates to a method for making an explosive composition by forming a fuel consisting of the reaction product of an organic acid and an iron compound and mixing the fuel with an inorganic oxidizing agent.

DESCRIPTION OF THE PREFERRED EMBODIMENT

Figure 1:
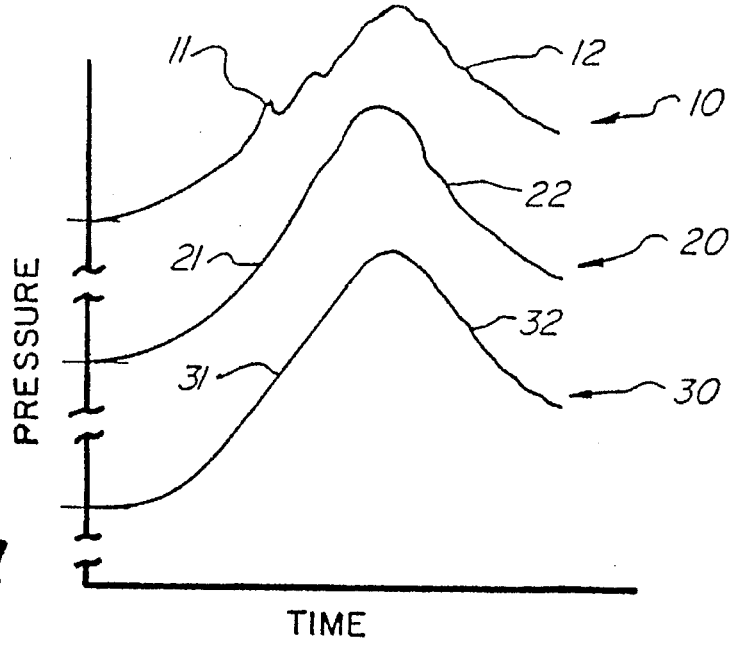
FIG. 1 is a graph containing three curves comparing the pressures evolved after firing three rounds, the first round containing Black Powder, the second round containing Pyrodex® and the third round containing an improved gunpowder embodying the present invention.

The fuel composition of the present invention comprises the reaction product formed as a result of mixing a transition metal or transition metal compound, preferably iron, iron hydroxide or iron oxide, with an organic acid, preferably ascorbic or erythorbic acid. The fuel composition of the present invention is preferably formed in the following manner: First, upon mixing a transition metal or transition metal compound, preferably an iron or iron compound, and ascorbic acid solution, an observable reaction occurs; namely, the clear acid solution becomes an opaque brownish-purple or black and gases, probably hydrogen and carbon dioxide, among others, are evolved; Second, upon evaporation of the solvent, a dried residue is produced. The dried residue is the reaction product which constitutes the improved fuel composition of the present invention. The fuel composition thus produced has exceptional adhesive qualities, and in fact is suitable for use in explosive compositions as a binder. The term "binder" as used herein, includes binders and modifiers. The dried residue product may be further processed as described below in Examples I through XII to enhance performance qualities of the fuel composition.

The explosive composition of the present invention comprises a mixture of an inorganic oxidizing agent, preferably a nitrate-containing inorganic oxidizer such as potassium nitrate, and the improved fuel of the present invention. The explosive composition thus produced has substantially enhanced performance characteristics and an unexpected decrease in hygroscopicity. Laboratory methods used to obtain the improved fuel composition and the improved explosive composition are described below in Examples I through VI. Methods used to obtain the improved fuel composition and the improved explosive composition which may be employed on a larger scale are described below in Examples VII through XII.

EXAMPLE I

Approximately 100 grams of powdered ascorbic acid are added to water in a glass or plastic container so as to create a saturated solution. The Ascorbic acid solution should be clear. Approximately 2 grams of iron in the form of iron filings are then added to the acid solution and the glass or plastic container is placed in sunlight. The solution slowly undergoes discernible changes, turning from greenish to brownish-purple to an opaque black. Such color changes usually are complete within four to seven days. Alternatively, the container can be heated to approximately 200° F. (93° C.) to accelerate the reactions evidenced by the changes in solution color and opacity.

Especially when there is a visible excess of iron, iron compound or other solids, the organic acid/iron reaction solution is filtered to remove all solids. The filtered solution is dried to produce a dried residue containing iron ascorbate and other compounds. This dried residue constitutes an improved fuel composition. This improved fuel composition, when properly manufactured, no longer contains ascorbic acid in any amount.

The fuel composition is then placed in a grinding apparatus. Although any suitable ball mill apparatus can be used to grind the fuel composition, preferably a rubber drum lapidary tumbler with a charge of ½" glass marbles is used to grind the fuel composition to a fine powder with an average particle size of approximately fifteen microns.

The powder thus produced is suitable as a binder, and if used as a binder, the iron or iron compound or other transition metal or transition metal compound reacting with the organic acid can have been supplied in a weight ratio of up to 3:10 transition metal or transition metal compound to organic acid, but is preferably supplied in a weight ratio of up to 2:10 transition metal or transition metal compound to organic acid.

To produce an improved explosive composition, approximately 200 grams of an inorganic oxidizer, preferably a nitrate-containing alkali metal oxidizer such as potassium nitrate, are added to the fuel composition. Although a weight ratio of approximately 35:65 fuel composition to potassium nitrate is presently preferred when potassium nitrate is the inorganic oxidizer, a satisfactory explosive composition with improved characteristics has been successfully obtained when the ratio by weight of fuel composition to potassium nitrate is from 20:80 to 50:50. The fuel composition residue and inorganic oxidizer mixture is placed in a grinding apparatus such as a rubber drum lapidary tumbler with a charge of ½" glass marbles and ground to a fine powder having an average particle size of approximately fifteen microns. Although the fuel composition and the inorganic oxidizer may be ground together rather than separately, they are preferably initially ground separately to maximize the safety of the operation and then thoroughly mixed together before use.

Water in the amount of approximately 8–10% by weight of the powder mixture is added to the powder mixture. The mixture is stirred so as to achieve a stiff, sticky mass. The mass is then spread or rolled onto a flat surface and allowed to air dry at room temperature.

The resulting dry material is then reground, preferably in rubber drum lapidary tumbler with a charge of ½" glass marbles. The ground mixture, constituting an improved explosive composition, is then removed from the tumbler.

Although optional, it is preferable to again add a sufficiently small amount of water to the mixture, with only so much water added as is necessary to moisten the mixture and cause the mixture, when stirred, to form a stiff and sticky mass. Again the mass is spread or rolled onto a flat surface and allowed to air dry at room temperature. Before drying is complete, pressure may be exerted on the almost dry material to achieve an explosive composition with bulk density similar to that of Black Powder.

EXAMPLE II

A fuel composition and an explosive composition similar to those obtained with the laboratory method described in Example I may be produced by preparing a saturated erythorbic acid solution and substituting the saturated erythorbic acid solution for the saturated ascorbic acid solution of Example I.

EXAMPLE III

An improved explosive composition suitable for use as a detonating compound may be produced by substituting ammonium nitrate or a mixture of ammonium nitrate and potassium nitrate in place of the potassium nitrate as the inorganic oxidizing agent of Examples I and II. Those skilled in the art will appreciate that the substitution of other inorganic oxidizing agents, such as the various chlorates, perchlorates, perborates and permanganates, for example, for ammonium or potassium nitrate as the inorganic oxidizing agent will also result in an improved explosive composition. The suitability of the improved explosive composition as a deflagration, pyrotechnic, detonation, propellant or other type of explosive compound will depend, in part, on the choice of the oxidizing agent. Moreover, an appropriate ratio of fuel composition to inorganic oxidizing agent will vary depending upon the particular inorganic oxidizing agent employed and the stoichiometric relationships among the explosive composition constituents. For example, while a satisfactory weight ratio of improved fuel composition to potassium nitrate is approximately from 20:80 to 50:50, a preferable weight ratio of improved fuel composition to ammonium nitrate is approximately from 5:95 to 25:75.

EXAMPLE IV

The fuel composition and the inorganic oxidizer powder mixture is obtained as described above in Example I. An alternate granulation method is then utilized in which the ground powder mixture is added to a rubber drum lapidary tumbler and moisture is introduced to the ground powder mixture via a stream of moist air, preferably passed through a scrubber, until the total water introduced is approximately 8–10% by weight of the mixture. The powder is then mixed by action of the tumbler, and when sufficiently agitated, moist granules of regular size and shape are produced. Agitation of the granular mixture is allowed to continue. Such continued agitation serves to polish the granules. It is believed that highly polished granule surfaces are responsible for a decreased hygroscopicity which has been observed with the resulting explosive composition.

Agitation is allowed to further continue until a desired bulk density is achieved. The currently preferred bulk density for the explosive composition when used as a gunpowder is that bulk density which is equivalent to approximately 75%–85% of the bulk density of Black Powder. A bulk density of approximately 75%–85% the bulk density of Black Powder is desirable because it has been determined that an equivalent mass of improved gunpowder substitute yields a velocity which is at least 15% greater than that of Black Powder.

A ballistics test performed with a Winchester Model 1894 carbine having a barrel length of 16 inches, a caliber of 0.45 and a cast lead 255 grain SWC projectile indicates the greater velocities obtained when using the improved explosive composition containing the improved fuel composition described herein as a deflagrating compound. The results of this ballistics test are summarized in the following table:

TABLE

| POWDER CHARGE | VELOCITY ft/sec |
|---|---|
| 28 grain Black Powder | 1050 |
| 20 grain improved explosive composition produced as described in Example IV | 1040 |
| 22 grain improved explosive composition produced as described in Example IV | 1094 |
| 24 grain improved explosive composition produced as described in Example IV | 1123 |
| 26 grain improved explosive composition produced as described in Example IV | 1207 |
| 28 grain improved explosive composition produced as described in Example IV | 1220 |

The presence of iron appears to be responsible for the changes in physical properties indicated by the performance results of the previous table. Although the chemical and/or physical changes resulting from the presence of iron are not currently precisely or completely known, it has been determined that the iron is critical to achieve enhanced adhesive qualities which promote granulation and to obtain the performance improvements indicated above. It is postulated that iron combines with the ascorbic or other organic acid and a fuel composition is created which is no longer composed of pure ascorbic or other organic acid. The resulting fuel composition appears to require less activation energy to initiate the oxidation-reduction process of the explosion reaction. The iron probably also acts as a catalytic agent, further assisting the efficiency and completeness of the explosion.

In the methods described herein, the enhancing effect of iron in the fuel and explosive compositions is generally provided by the addition of iron filings to an organic acid solution. However, the explosive composition described by the present invention has also been produced by reaction of an organic acid with an iron compound, in the form of ferrous oxide (FeO), ferric oxide ($Fe_2O_3$), other iron oxides and ferrous hydroxide ($Fe(OH)_2$), and these and other iron compounds may be successfully substituted for iron filings in the methods described by Examples I through XII. As used herein, the term iron compounds includes iron compounds and iron containing compounds.

Although an iron content of up to approximately 10% by weight of the fuel component produces a fuel composition and an explosive composition exhibiting improved characteristics, an iron content of up to approximately 5% by weight of the fuel component is preferable. Thus, when reacting $Fe_3O_4$ with an organic acid to form a fuel composition, the weight ratio of $Fe_3O_4$ to organic acid is preferably up to approximately 6% by weight of the fuel component so as to achieve a preferable iron content of up to approximately 5% by weight of the fuel component. In any case, no matter what form the iron is introduced to the fuel composition, when excess iron is allowed to remain, such as when the iron and organic acid solution is not filtered, the resulting explosive composition exhibits decreased burn characteristics and undesirable residue is created.

Furthermore, other transition metals and transition metal compounds, including transition metal oxides and transition metal salts, may be utilized in place of the iron or iron containing compound to form an improved fuel composition. Although utilization of different transition metal or transition metal compounds produces fuels compositions with different performance characteristics, use of other transition metals, such as titanium, manganese, copper, nickel and zinc, and compounds thereof to form fuel compositions as described herein produces improved fuel compositions which may be mixed with inorganic oxidizing agents as described herein to produce improved explosive compositions.

EXAMPLE V

A fuel composition and an explosive composition similar to those obtained with the laboratory method described in Example IV may be produced by preparing a saturated solution of erythorbic acid and substituting the saturated erythorbic acid solution for the saturated ascorbic acid solution of Example IV.

EXAMPLE VI

An improved explosive composition suitable for use as a detonating compound may also be produced by substituting ammonium nitrate or a mixture of ammonium nitrate and potassium nitrate in place of the potassium nitrate as the inorganic oxidizing agent of Examples IV and V. Again, those skilled in the art will appreciate that the substitution of other inorganic oxidizing agents, such as the various chlorates, perchlorates, perborates and permanganates, for example, for ammonium or potassium nitrate as an inorganic oxidizing agent will result in an improved explosive composition. The suitability of each explosive composition as a deflagration, pyrotechnic, detonation, propellant or other type of explosive compound will depend, in part, on the choice of the oxidizing agent.

EXAMPLE VII

An oxidizer powder is prepared by finely grinding potassium nitrate salt. Preferably, two pounds of oxidizer may be placed in a ball mill for each gallon (U.S. gallon) of mill capacity. The oxidizer is ground with sufficient ½" grinding media to fill half the volume of the mill. When using a one gallon ball mill, a sufficiently finely ground oxidizer is achieved after nine to twelve hours at 55 revolutions per minute. When using other equipment or under varying conditions, the oxidizer should be ground for whatever period of time is required, given the size of the mill, loading density, speed of rotation, and other factors, to produce a fine powder having an average particle size of approximately fifteen microns with the consistency of talc without crystals or particulate matter detectable.

An organic acid solution is prepared by adding approximately one pound of dried ascorbic acid to water, with the water in sufficient quantity to completely dissolve the ascorbic acid when heated in a water bath at approximately 200° F. (93° C.). The acid solution is maintained in the water bath until the temperature of the acid solution stabilizes.

Iron or an iron compound, preferably iron filings or iron oxide in a preferred amount of 10–15 grams, is then added to the acid solution. The resulting solution is maintained in the water bath for approximately one hour at which time the iron oxide will have dissolved in the acid and the solution will have become a dark brown-black.

The dark brown-black solution is removed from the water bath and poured into a shallow pan. The pan is placed in an oven at approximately 175°–225° F. (107° C.) and the solution is allowed to dry. Ordinarily drying is accomplished in 24 to 48 hours. Drying of the solution is complete when the resulting residue becomes black and is very puffy and friable. The black, puffy residue which constitutes a fuel composition and is believed to contain iron ascorbate and other compounds, is allowed to cool to room temperature.

The fuel composition is then ground to a fine powder. Preferably two pounds of the fuel composition may be placed in a ball mill for each gallon (U.S. gallon) of mill capacity. The fuel composition is ground with sufficient ½" grinding media to fill half the volume of the mill. The fuel composition should be ground so that the average particle size is approximately fifteen microns and the fuel composition has the consistency of talc without any crystals or particulate matter detectable. Of course when using other equipment or under varying conditions, the fuel composition should be ground for whatever period of time is required to produce a fine powder, given the size of the mill, loading density, speed of rotation, and other factors. When using a one gallon ball mill, a sufficiently finely ground fuel composition is obtained after nine to twelve hours at 55 revolutions per minute.

In order to mix the oxidizer and the fuel composition powders as intimately as possible prior to granulation, it is preferable that both powders be ground together in a ball mill for one to two hours in the presence of grinding media. Alternatively, separate grinding of the oxidizer and the fuel composition as described above may be omitted and a finely ground mixture of the oxidizer and the fuel composition residue obtained by grinding the mixture for a sufficiently long period of time. Separate grinding is believed to be slightly safer.

The powder mixture is then placed in a vibrating bowl such as a vibratory cartridge case cleaner. Preferably the vibrating bowl is loaded to full capacity. The vibrator is operated while a minimum of moisture is introduced in as fine a mist as possible and in such a way that granules are formed. A mister of the type used in green houses has been successfully used for adding water to the mixture in the described manner. When the top layer of the mixture becomes wet and dark the mister should be removed, the vibrator lid closed and the vibrator allowed to act on the mixture. This will result in the moisture being dispersed and any lumps being reduced in size. The vibrator should then be uncovered, additional moisture added to the product with the mister and the process repeated as previously described until the mixture becomes completely granulated and black in color. Preferably, the total amount of water added by misting to the mixture is that amount which is necessary to obtain the black, granulated product, and should total approximately 8–10% by weight of the granulated product. The addition of water to the mixture too rapidly or in an excessive amount is detrimental as it will result in the formation of undesirable lumps of material.

After the mixture becomes completely black and granulated, the granules must be polished by continued operation of the vibrator, usually for four to five hours. Polishing of the granules is apparent as the granules become more round and smooth and less irregular. If any dust appears, sufficient moisture should be added to the granules to settle the dust and resume polishing.

The finished granules, which constitute an improved explosive composition should then be completely dried. Drying of the granules is preferably achieved by placement in an oven at 200° F. (93° C.) for approximately four hours. After drying, if it is determined that the finished granules are too large, the product may be ground as described above and the granulation and polishing process repeated.

EXAMPLE VIII

A fuel composition and an explosive composition similar to those obtained with the method described in Example VII may be produced by preparing a saturated solution of erythorbic acid and substituting the saturated erythorbic acid solution for the saturated ascorbic acid solution of Example VII.

EXAMPLE IX

An explosive composition similar to those obtained with the methods described in Examples VII and VIII may be produced by substituting ammonium nitrate or a mixture of ammonium nitrate and potassium nitrate in place of the potassium nitrate as the inorganic oxidizing agent of Examples VII and VIII. Other improved explosive compositions of a different character may be obtained by substituting other oxidizing agents for either ammonium or potassium nitrates, such other oxidizing agents chosen to obtain desired performance characteristics.

EXAMPLE X

The oxidizer is prepared in the same manner as described previously in Example VII. A solution of ascorbic acid is prepared by adding one pound of dried ascorbic acid to 500 milliliters of water. The acid solution is heated and brought to a boil. Approximately 10–15 grams of iron oxide is then added to the boiling solution and a low boil is maintained for at least four hours during which time the temperature of the solution is allowed to slowly climb to 225°–240° F. (110° C.). A controlled temperature rise must be maintained by adding water to counteract a too rapid increase in solution temperature. This solution, referred to herein as the fuel solution, is removed from the heat.

The oxidizer powder is then blended into the fuel solution. Preferably an electric mixer having blades that tend to mix and chop is used. As the material being mixed cools, the material stiffens. As the temperature of the cooling material approaches room temperature, it begins to separate into granules. Mixing should continue while cooling the material to 40° to 50° F. (4° to 10° C.) until a desired granule size is reached.

The granules are removed from the mixer and placed in the vibrator. The granules are then vibrated until they are partially dry and sufficiently polished and dark brown in color.

The dark brown granules are then placed in an oven at 175°–225° F. (107° C.) and allowed to dry. Sufficient dryness has been achieved when the moisture content is less than 1%. The resulting dried granules, which constitute the improved explosive composition, may be reground, vibrated again and slightly moistened, if desired, to obtain a particular granule size or to enhance performance of the composition.

EXAMPLE XI

A fuel solution and explosive composition similar to that obtained with the method described in Example X may be produced by substituting altered erythorbic acid for the completely altered ascorbic acid of Example VII.

EXAMPLE XII

An explosive composition similar to those obtained with the methods described in Examples X and XI may be produced by substituting ammonium nitrate or a mixture of ammonium nitrate and potassium nitrate in place of the potassium nitrate as the inorganic oxidizing agent of Examples X and XI. As previously discussed, one skilled in the art will appreciate that other oxidizing agents may be substituted to produce an explosive composition having the desired performance characteristics, and the weight ratio of fuel composition to oxidizing agent will depend, in large part, on the stoichiometric relationship of the fuel composition and the oxidizing agent in the resulting explosive composition.

When produced as described above in Examples I through XII, an improved explosive composition is produced which approaches the effectiveness of nitrocellulose based, smokeless gunpowders in some calibers and which outperforms Black Powder and other gunpowder substitutes. Various ballistic tests have been performed substantiating performance characteristics of the improved explosive composition produced as described above. One such ballistic test is illustrated by FIG. 1. FIG. 1 contains three curves 10, 20 and 30, which illustrate pressure measurements obtained after firing three rounds, the first round having a powder charge of 100 grains by volume of Black Powder (curve 10), the second round having a powder charge of 100 grains of Pyrodex® (curve 20) and the third round having a powder charge of 100 grains of the improved explosive composition (curve 30) produced as described above in Example IV, each round having been fired in a Thompson Center White Mountain carbine having a barrel length of 20" and loaded with a 410 grain Hornady bullet. In FIG. 1, the vertical axis represents pressure while the horizontal axis represents the time over which pressure measurements are taken. While the initial pressure measured for each of the three test rounds fired are approximately the same and are shown at the three points of intersection of the curves 10, 20 and 30 with the vertical axis, the three curves have been vertically displaced and separated to aid a comparison of the pressures measured after firing the three rounds. The initial upwardly curving portions 11, 21 and 31 of the curves 10, 20 and 30 respectively, indicate that pressures are initially building after each round is fired. The subsequent downwardly curving portions 12, 22 and 32 of the curves 10, 20 and 30 respectively, indicate that pressures are subsequently decreasing. Of special significance is the smoothness of curve 30. As shown in FIG. 1, curve 30 is smoother than curve 20, while curve 20 is smoother than curve 10. The smoothness of the curve 30 indicates the regularity of the burn rate of the improved explosive composition being measuring. A more regular burn rate indicates a better utilization of product and more predictable performance in the field.

The firing of the three rounds illustrated by the three curves 10, 20 and 30 as shown in FIG. 1 and described above each resulted in the expulsion of three bullets. The muzzle velocities of the three bullets are described in the table which follows:

TABLE

| POWDER CHARGE | VELOCITY ft/sec |
|---|---|
| 100 grain Black Powder | 1235 |
| 100 grain Pyrodex ® | 1348 |
| 100 grain improved explosive composition | 1378 |

As can be seen from the above table, the velocity of the bullet propelled by firing the round containing the improved explosive composition is greater than the velocities of the bullets propelled by firing the round of Black Powder or the round of Pyrodex®.

Figure 2:
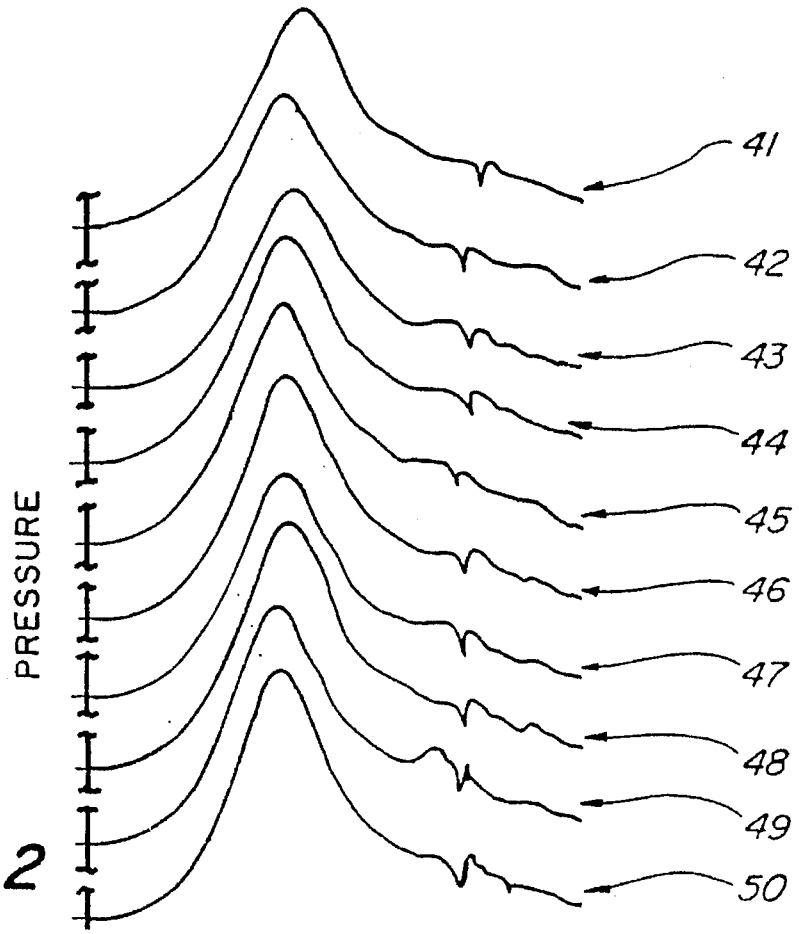
FIG. 2 is a graph containing ten curves each of which illustrates the pressures and velocities evolved after firing rounds containing identical amounts of an improved gunpowder embodying the present invention.

A second ballistic test is illustrated by FIG. 2. FIG. 2 contains ten curves 41, 42, 43, 44, 45, 46, 47, 48, 49 and 50, each of which show pressure measurements obtained as a result of firing a single round having a powder charge of 95 grains by volume of the improved explosive composition produced as described above in Example IV. Each round was fired with a Thompson Center White Mountain carbine having a barrel length of 20" and loaded with a 410 grain Hornady bullet. While the initial pressure measured for each of the ten test rounds fired are approximately the same and are shown at the ten points of intersection of the curves 41 through 50 with the vertical axis, the ten curves have been vertically displaced and separated to aid a comparison of the pressures measuring after firing the ten rounds. Each of the ten curves 41 through 50 have an initial upwardly curing portion analogous to the portion 31 of the curve 30 of FIG. 1 indicating pressures are building. Each of the ten curves 41 through 50 have a subsequent downwardly curving portion analogous to the portion 32 of the curve 30 of FIG. 1 indicating that pressures are subsequently decreasing. Of significance is the substantial similarity of the ten curves 41 through 50 and the smoothness of each of the ten curves. The smoothness of each of the ten curves 41 through 50 indicates the regular burn rate of each round of the improved explosive composition. The substantial similarity among each of the ten curves 41 through 50 indicates the outstanding consistency experienced when firing duplicate rounds of the improved explosive composition.

Presently preferred embodiments of the present invention and many of its improvements have been described with a degree of particularity. It should be understood that this description has been made by way of preferred examples, and that the invention is defined by the scope of the following claims.

What is claimed is:

1. A method of making explosive compositions comprising the steps of:

mixing in aqueous solution an organic acid and a transition metal containing material which will react with said organic acids in said aqueous solution, said transition metal containing material selected from the group consisting of transition metals, transition metal compounds, and mixtures thereof to create a transition metal and organic acid reaction product salt;

drying the reaction product salt; and then mixing the dry reaction product salt with an inorganic oxidizer to produce explosive compositions.

2. A method of making explosive compositions as defined in claim 1 comprising the additional step of forming granules of the mixture of reaction product and the inorganic oxidizer mixture.

3. A method of making explosive compositions as defined in claim 1 wherein the inorganic oxidizer is selected from the group consisting of potassium nitrate, ammonium nitrate and mixtures thereof.

4. The method of making explosive compositions as defined in claim 3 wherein the organic acid is selected from the group consisting of ascorbic acid and erythorbic acid.

5. The method of making explosive compositions as defined in claim 4 wherein the material selected from the group consisting of transition metals, transition metal compounds and mixtures thereof are further selected from the iron containing material group consisting of iron, iron oxides, iron hydroxides, iron alloys, and iron salts.

6. The method of making explosive compositions as defined in claim 5 wherein the material selected from the iron containing material group includes an iron oxide.

7. The method of making explosive compositions as defined in claim 6 wherein the material selected is iron oxide, and wherein the organic acid is ascorbic acid.

8. A method of making explosive compositions as defined in claim 7 wherein the inorganic oxidizer is potassium nitrate.

9. A method of making explosive compositions as defined in claim 8 wherein the reaction product and the potassium nitrate are present in a weight ratio of about 35:65.

10. A method of making explosive compositions as defined in claim 1 wherein the inorganic oxidizer is a nitrate-containing inorganic oxidizer selected from the group consisting of potassium nitrate, ammonium nitrate and mixtures thereof; and the dry reaction product and the inorganic oxidizer are present in a ratio of from about 20:80 to about 50:50 by weight.

11. A method of making explosive compositions as defined in claim 10 wherein the reaction product and the inorganic oxidizer are ground separately before they mixed together.

12. A method of making explosive compositions as defined in claim 11 which includes a granule forming step including the steps of mixing water with the reaction product and inorganic oxidizer mixture, and then drying the wet reaction product and inorganic oxidizer mixture.

13. The explosive compositions made by the method of claim 12.

14. The explosive compositions made by the method of claim 1.

15. A method of making explosive compositions comprising the steps of:

mixing in an aqueous solution an organic acid selected from the group consisting of ascorbic acid and erythorbic acid and an iron containing material which will react with said organic acid in such an aqueous solution, said iron containing materials selected from the group consisting of iron, iron oxides, iron hydroxides, iron alloys, and iron salts, and mixtures thereof to create an iron and organic acid reaction product salt;

drying the iron and organic acid reaction product salt; and then mixing the dry reaction product salt with an inorganic oxidizer selected from the group consisting of potassium nitrate, ammonium nitrate and mixtures thereof to produce explosive compositions.

16. The method of making explosive compositions as defined in claim 15 wherein the iron containing material includes an iron oxide, and wherein the organic acid is ascorbic acid.

17. The explosive compositions made by the method of claim 16.

* * * * *